United States Patent [19]

Abarotin et al.

[11] 4,421,256

[45] Dec. 20, 1983

[54] SLIDING GATE VALVE HAVING ADJUSTABLE SEAL PRESSURE

[75] Inventors: Eugene V. Abarotin, Franklin Township, Westmoreland County; Leroy V. Bonk, Pittsburgh, both of Pa.

[73] Assignee: United States Steel Corporation, Pittsburgh, Pa.

[21] Appl. No.: 307,834

[22] Filed: Oct. 2, 1981

[51] Int. Cl.[3] ..... B22D 41/08

[52] U.S. Cl. ..... 222/600; 222/512; 251/187; 251/193

[58] Field of Search ..... 251/152, 187, 193; 222/598, 600, 512

[56] References Cited

U.S. PATENT DOCUMENTS

| | | | |
|---|---|---|---|
| 3,765,579 | 10/1973 | Cramer et al. | 222/600 |
| 3,786,969 | 1/1974 | Kelly | 222/600 |
| 3,937,372 | 2/1976 | Bode, Jr. | 222/600 |
| 4,116,372 | 9/1978 | Horiguchi et al. | 222/600 |
| 4,344,550 | 8/1982 | Szadkowski | 222/600 |

FOREIGN PATENT DOCUMENTS 50-64122 5/1975 Japan .

*Primary Examiner*—David A. Scherbel
*Attorney, Agent, or Firm*—John F. Carney

[57] ABSTRACT

A sliding gate valve mechanism for use in teeming molten metal is provided with apparatus for accurately setting seal pressure between the valve plates and for adjusting the seal pressure during periods of valve operation. The invention enables such adjustments to be made to rectify malfunctions in valve operation without need to terminate teeming and to dismantle the valve mechanism. The invention is particularly advantageous in that the role played by mechanical springs in imparting valve seal pressure is relegated to secondary importance as leakage of molten metal between the plates can be terminated regardless of the operability of the springs.

11 Claims, 5 Drawing Figures

SLIDING GATE VALVE HAVING ADJUSTABLE SEAL PRESSURE

BACKGROUND OF THE INVENTION

The present invention relates to sliding gate valves for controlling the flow of molten metal from teeming vessels. Such valves normally comprise a pair of refractory plates arranged to be slidable with respect to one another and containing through-openings that coact to control the flow of metal passing through the valve in accordance with the degree of registration therebetween.

It is incumbant in the operation of valves of the sliding gate type that an accurate amount of sealing pressure be applied between the plates. The application of excessive sealing pressure between the plates impedes, or may even prevent, relative sliding movement therebetween thus rendering the valve inoperative. The application of too little pressure, on the other hand, can result in metal leakage between the plates.

Sealing pressure is generally applied between the plates in such valves by imparting an upward bias against the slide plate forcing it into fluid tight sliding contact with the mating top plate positioned thereabove. Although, as shown in U.S. Pat. No. 3,511,261 granted May 12, 1970 to Bick, et al, this upward bias may be applied by accurately torquing the threaded connectors that maintain the valve components in assembled relation, more desirably the bias is provided by the application of spring pressure which, as shown in U.S. Pat. No. 4,063,668 granted Dec. 20, 1977 to E. P. Shapland, et al, may take the form of an array of mechanical springs set in the gate frame below the gate plate and arranged about the metal flow opening to apply an upward bias around the opening effective to place the mating surfaces of the plates in fluid tight sliding contact.

Locating the springs in close proximity to the plate opening through which molten metal flows has the undesirable effect of subjecting them to the elevated temperatures produced by the molten stream. The springs are accordingly subjected to thermal stresses which can result in relaxation and ultimate failure of the springs unless adequate cooling thereof is provided as, for example, by the application of a cooling air flow thereto.

It has been suggested, in order to ameliorate the aforementioned problem, to provide a sliding gate valve mechanism in which the springs for applying seal pressure between the refractory plates are located in a position remote from the plates and, concomitantly, from the metal flow stream, and to impart the spring bias to the plates through an appropriate elongated and articulated connecting linkage. Such a valve arrangement is shown and described in U.S. Pat. No. 3,937,372 granted Feb. 10, 1976 to C. H. Bode, Jr. Use of the valve described in this patent under adverse metal pouring conditions indicates that the arrangement is not totally dispositive of the problem however due in part to the fact that the springs may yet undergo relaxation and the elongated linkage is itself subjected to heat and thereby prone to elongate whereupon the effective seal pressure is reduced.

It is to the solution of the aforementioned problems, therefore, that the present invention is directed.

SUMMARY OF THE INVENTION

Accordingly, the present invention provides a sliding gate valve apparatus for controlling the flow of molten material from the outlet of a teeming vessel including a gate movable with respect to said vessel outlet, drive means for moving said gate with respect to said vessel outlet, and means for imparting seal pressure between said gate and vessel outlet, said means comprising a fluid-operated loader remotely positioned from said gate and operative to generate a force in response to the admission or release of fluid with respect thereto; a fluid system connected to said loader for selectively regulating the flow of fluid thereto; and connecting means between said loader and said gate for translating the force generated by said loader into a sealing bias between said gate and said vessel outlet.

It will be appreciated that sliding gate valve apparatus constructed according to the present invention overcomes the above-described deficiencies of prior art devices of similar kind. Provision of valve loading mechanism as defined herein enables that apparatus responsible for the generation of forces to produce the sealing pressure between the mutually sliding members to be located remote from the sliding members and, concomitantly, away from the high temperature environment in which these members are located. This attribute alone enhances valve operation by subjecting the apparatus to reduced thermal stresses thereby extending its effective life.

Also, the use of hydraulic means for generating the forces that give rise to seal pressure between the sliding members enables the application of infinitely variable seal pressures that can be accurately determined prior to initiation of valve operation and, thereafter, selectively varied in response to valve operating conditions, thereby effecting a relatively constant seal pressure between the members.

Other improvements are embodied in the construction of the hereindescribed valve that reduce the effect of thermal elongation on valve operation and reduce to a minimum the danger of valve malfunction that might otherwise be caused by misalignment of the mutually sliding members.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
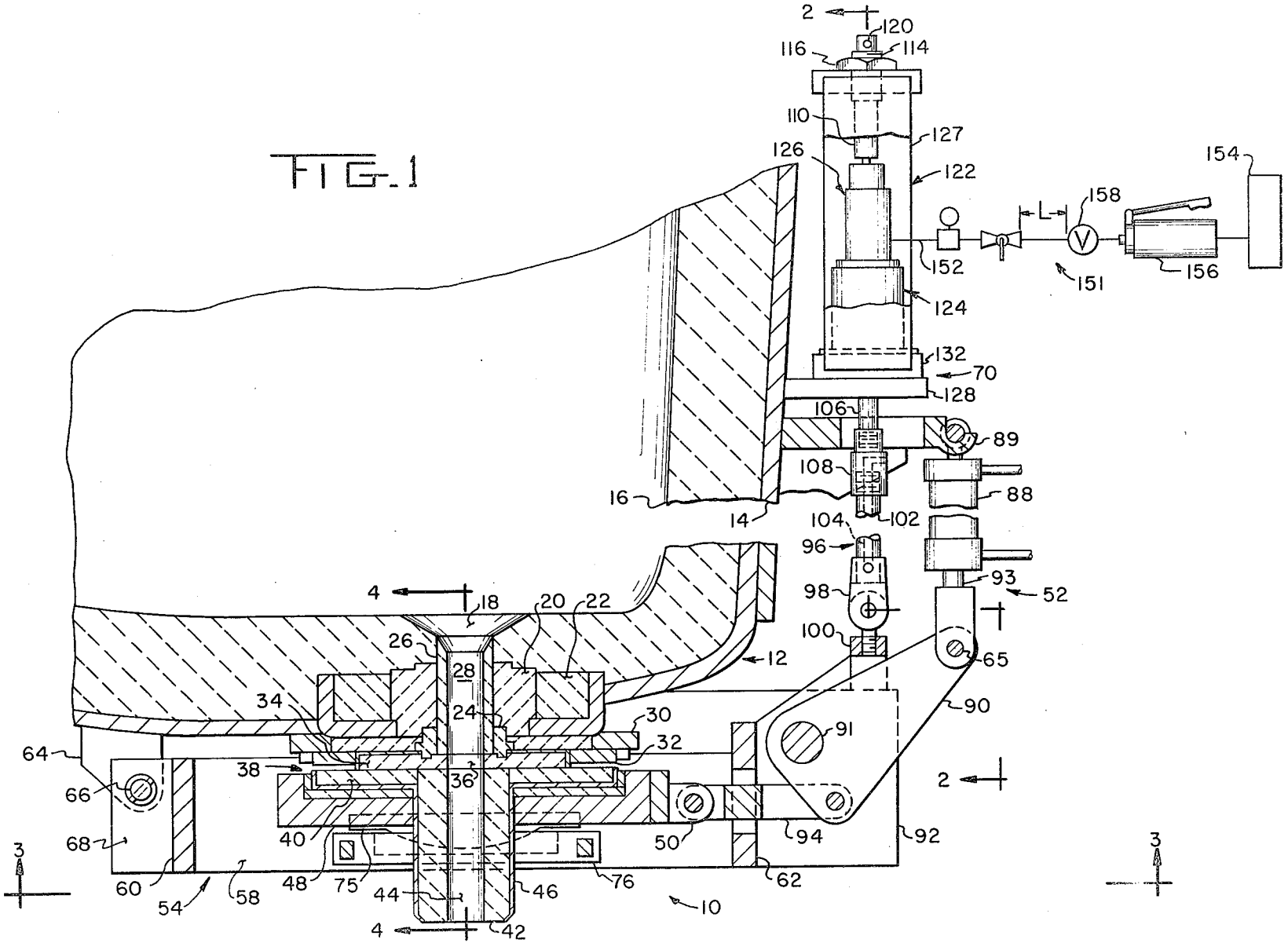
FIG. 1 is a partial vertical sectional representation, partly schematic, of a teeming vessel equipped with a sliding gate valve apparatus constructed according to the present invention.

Referring to the drawings there is shown in FIG. 1 a sliding gate valve apparatus 10 operatively attached to the bottom side of a molten metal teeming vessel 12 that may be a ladle for supplying molten metal to ingots, or the like. The vessel 12 includes a metal shell 14 having a refractory lining 16. The lining 16 covering the bottom of the vessel shell contains a well opening 18 defining the molten metal pour passage from the vessel. The well opening 18, as is conventional practice, contains well-forming refractories, 20, 22 and 24 respectively, and a nozzle insert 26, the opening 28 through which defines the vessel pour opening.

The valve apparatus 10 is attached to the vessel by mounting means that include a leveling plate 30 weldedly secured to the vessel shell and a mounting plate 32 connecting the leveling plate by bolts (not shown). The mounting plate is recessed to receive a refractory plate 34 containing a through opening 36 in axial alignment with the nozzle opening 28. This plate 34, referred to as the top plate, has a lower surface adapted for mating sliding contact with a cooperating surface on a movable slide gate 38.

The slide gate 38 includes a refractory plate 40 having an upwardly-facing slide surface for engagement with the top plate 34. A nozzle element, termed the collector nozzle 42, depends from the plate 40 and contains an opening 44, which when aligned with the top plate opening 36, effects flow of metal through the valve apparatus 10. Alternatively, when the gate 38 is moved to position the opening 44 out of registry with the top plate opening 36, all as is well known in the art, the flow of metal is terminated. Both the top plate 34 and the slide gate 38 may be each enclosed in a thin metal casing 46 that does not form part of this invention.

The slide gate 38 is mounted in the valve 10 in a gate carrier 48 which contains a recess for reception of the refractory plate 40 and a bottom opening to accommodate the downwardly depending collector nozzle 42. A clevis 50 at one end of the carrier 48 permits connection to a drive, indicated generally at 52, for effecting reciprocatory movement of the carrier and contained gate 38 within a frame structure 54 that provides vertical support therefor.

Frame 54 is comprised of upstanding, rectangularly arranged plates including oppositely spaced side plates 56 and 58 and end plates, 60 and 62 respectively, that are welded or otherwise joined into a unitary structure. Brackets 64 depending from the vessel shell 14 accommodate pivot pins 66 that pass through openings in extensions 68 in the side plates 56 and 58 for pivotally coupling the frame 54 at one end in its operative position to the vessel 12. The other end of the frame 54 is adjustably vertically supported by force transmitting apparatus 70 that provides sealing pressure between the mating surfaces of the top plate 34 and slide gate 38 as hereinafter more fully described.

Figure 2:
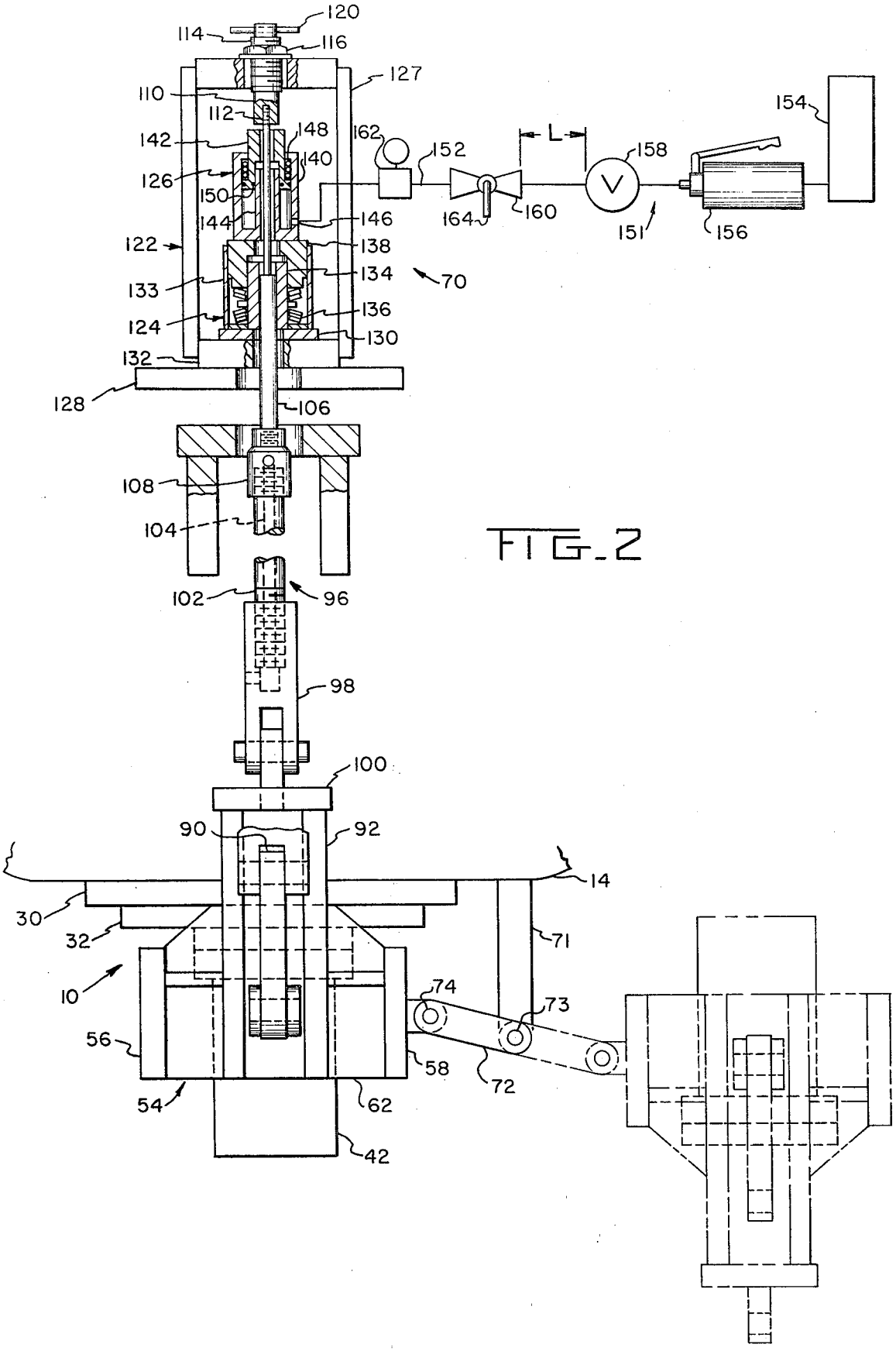
FIG. 2 is an end view of the vessel and attached sliding gate valve apparatus as viewed from the right of FIG. 1 and illustrating the components of a force applicator in greater detail.
Figure 3:
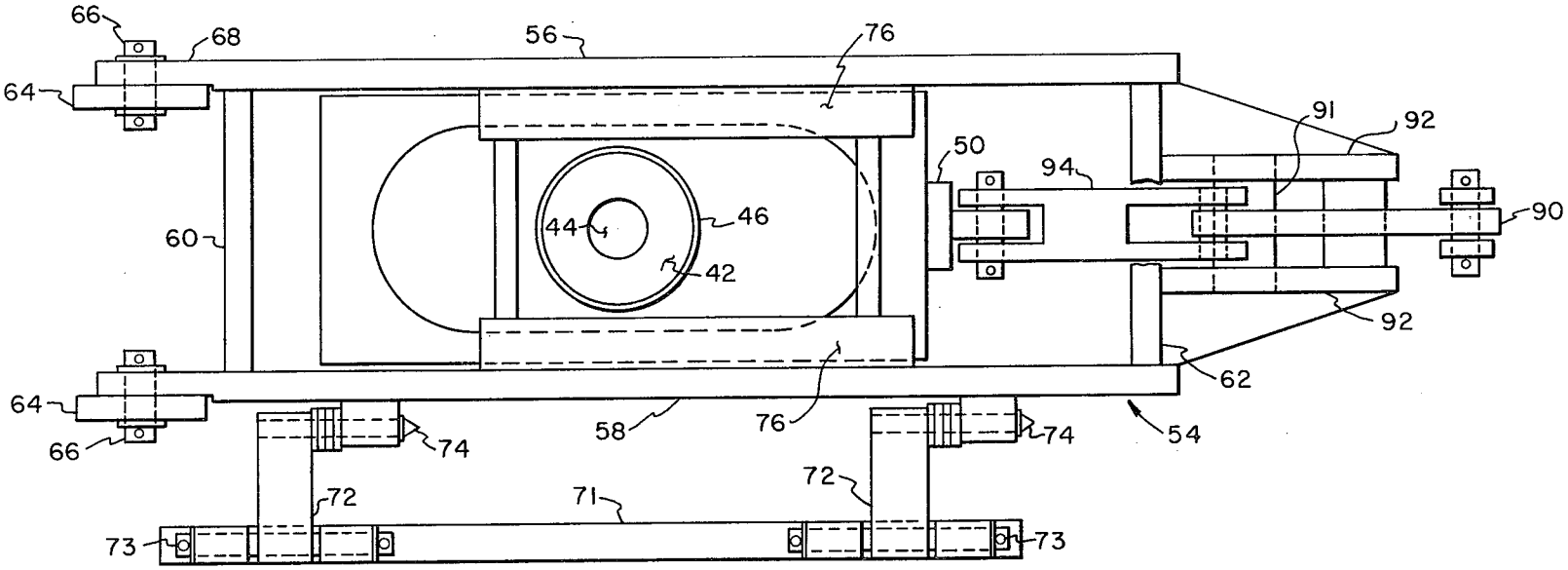
FIG. 3 is a bottom view of the sliding gate valve apparatus of FIG. 1.

In order to facilitate replacement of the top plate 34 and slide gate 38, as is frequently required, the frame 54 is arranged to be also pivotally connected along side wall 60 to a support 71 suspended from the vessel bottom. Pivot connection between the frame 54 and support 71 is effected by hinge links 72 connected at one end by pins 73 to the support and connected at their other ends to the frame 54 by means of pins 74. It will be appreciated that by removing pins 66 from the brackets 64 and disconnecting the other end of the frame 54 from the force transmitting apparatus 70 the frame can be pivotally parted from the mounting plate 30 as shown in phantom in FIG. 2 to expose both the top plate 34 and slide gate 38 for their replacement.

Figure 4:
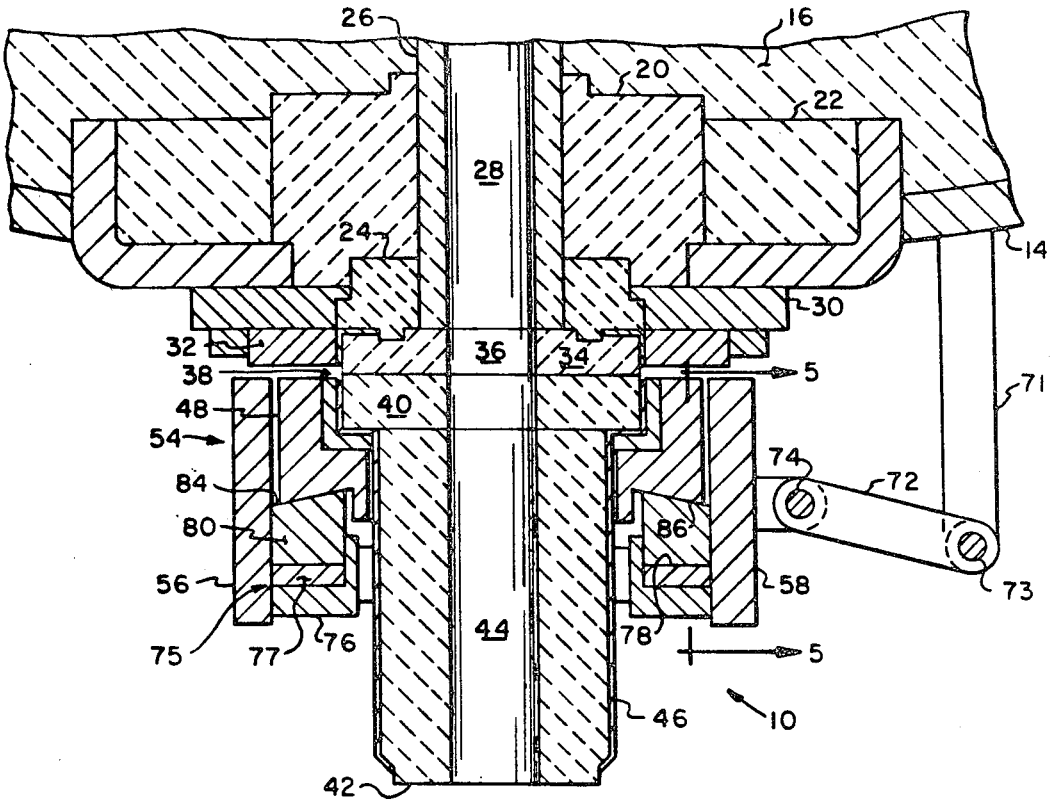
FIG. 4 is a vertical section taken along line 4—4 of FIG. 1.
Figure 5:
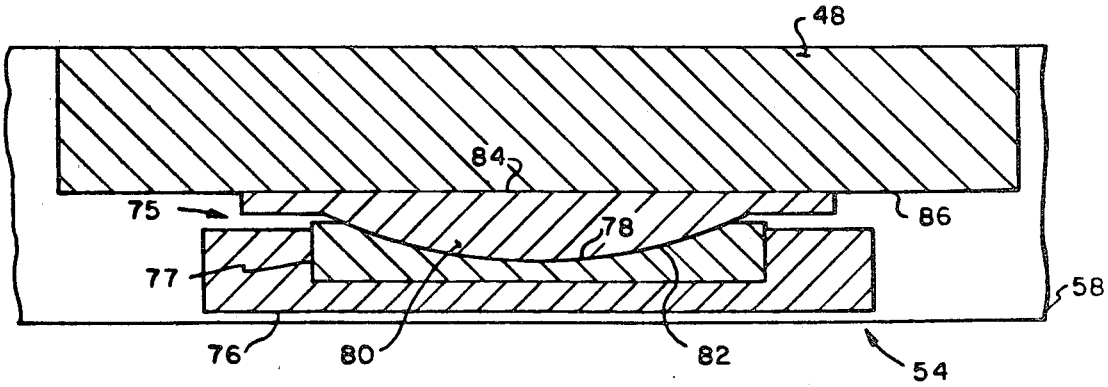
FIG. 5 is a view taken along line 5—5 of FIG. 4.

Sliding movement of the gate carrier 48 within the frame 54 is accommodated by slide guides 75 that are particularly configured to enable the gate 38 to be self-aligning with respect to the top plate 34. The slide guides 75, as shown in FIGS. 4 and 5, are elongated in the direction of gate carrier movement and are disposed on opposite sides of the carrier. Each comprise a support base 76 affixed to the interior surface of the respective frame side plates 56 and 58, a seat 77 having an arcuate seating surface 78 mounted on the base, and a rocker 80 having a lower surface 82 complimentary with the seating surface of the seat positioned therein. The upper surface 84 of each rocker 80 is shaped as a segment of a cylinder and is adapted to engage the undersurface of complimentary-shaped shoulder 86 that extends along each longitudinal side of the gate carrier 48. It will be appreciated that the axis of curvature of the surfaces 84 on the rockers 80 is disposed in a plane containing the longitudinal axis of the frame 54 and that the cooperation between these surfaces 84 and the rockers 80 in seats 77 enable the slide gate 38 to be self-aligning both longitudinally and transversely of the mechanism.

Reciprocatory movement is imparted to the carrier 48 with respect to the frame 54 by means of drive 52 that comprises a double-acting fluid pressure cylinder 88 or equivalent linear motion device removably suspended from a bracket 89 on the side wall of the vessel 12. A bell crank 90 is pivotally secured by pin 91 that extends between apertured brackets 92 from the end of the frame 54. One arm of the bell crank 90 is pin connected to a piston rod 93 extending from cylinder 88 and the other arm is pin connected to a link 94 that connects with the clevis 50 on the carrier 48.

Sealing pressure between the top plate 34 and slide gate 38 is provided by force transmitting means 70 that connect with the frame 54 at the end opposite that containing pivot pins 66, the connection being such as to translate an upwardly directed force on the force transmitting means into an upward bias on the slide gate 38 against the top plate 34. As shown in the drawings the force transmitting means 70 includes a vertically elongated connecting rod assembly 96 attached at its lower end via clevis 98 to a frame appendage 100. Connecting rod assembly 96 comprises axially spaced interconnected sections, including a larger diameter portion 102 containing an axial passage 104 adapted for connection to a pressurized source of cooling air, (not shown) an intermediate portion 106 connecting with portion 102 via union 108, and an end portion 110 internally threaded at 112 for connection with portion 106 and externally threaded at 114 for reception of safety nut 116. Provision is made on the end portion 110 for reception of pin 120 that operates to prevent detachment of the nut 116 from the connecting rod assembly by undue retrograde movement of the former.

According to the invention, there is provided a valve loading mechanism 122 that is telescopically received about, and operates on, the connecting rod assembly 96 adjacent its upper end. Mechanism 122 includes a spring package 124 and hydraulic force applicator 126 superposed thereon within a frame 127 that is fixedly mounted on vessel platform 128. The spring package 124 comprises a base 130 seated on frame base 132, a cylindrical enclosure 133 and guide sleeve 134 concentrically upstanding from the base, and a plurality of disc springs 136 interposed between the enclosure 133 and sleeve 134. A movable cover 138 closes the top of the package and is adapted to transfer forces between the hydraulic force applicator 126 and the springs 136.

The hydraulic force applicator 126 includes a fluid cylinder 140 mounted for movement with the cover 138 and a plunger 142 operably positioned within the cylinder for guided extended and retracted movement along stem 144 in response to the application of hydraulic fluid to the cylinder via supply opening 146. A return spring 148 operates to assist retraction of the plunger 142 and O-ring seals 150 may be provided to prevent leakage of fluid from occurring between the cylinder and the plunger.

The arrangement of the valve loading mechanism 122 is such that seal pressure between the valve top plate 34 and slide gate 38 is generated by the application of fluid pressure to the force applicator 126 while the spring package 124 operates to absorb instantaneous thermally- or mechanically-induced changes that may occur in the mechanical system defining the force transmitting means 70.

Hydraulic fluid is supplied to the cylinder 140 by a fluid system 151, represented schematically in the drawings, comprising a supply line 152 that connects opening 146 with a source of operating fluid, indicated as reservoir 154. Installed in series in the supply line 152 between the reservoir and the cylinder opening are a manually-operated pump 156, a flow control valve 158, a pump load holding valve 160 and a pressure gage 162, all of which are conventional, readily available elements. Control valve 158 functions to simply open or close the line 152 for the passage of fluid from pump 156. Load handling valve 160 is a valve, which, when operating handle 164 is disposed in one position, operates as a check valve to maintain fluid pressure between the cylinder 140 and valve 160. Rotation of the handle 164 to a second position permits fluid to return through the valve 160 thereby enabling the selective reduction of fluid pressure in the cylinder 140.

The operation of a sliding gate valve apparatus 10 incorporating the hereindescribed invention is as follows. With the valve frame 54 in the position shown in phantom in FIG. 2 following replacement of the top plate 34 and slide gate 38 the frame is moved by rotation of the hinge links 72 into its operative position beneath the vessel 12. Pivot pins 66 are thereupon inserted in the brackets 64 and pin 65 is put in plate 90 to connect the apparatus to the force transmitting means 70 and to the slide gate drive 52. Following this, with control valve 158 open and valve 160 in the load holding mode, pump 156 is actuated to supply hydraulic fluid from the reservoir 154 to the cylinder 140 of force applicator 126. Fluid entering the cylinder 140 operates to extend plunger 142 upwardly and to compress the cover 138 of spring package 124 downwardly thereby to load the springs 136 in compression. Desirably, fluid is admitted to cylinder 140 until a line pressure of about 1800 psi indicating desired seal pressure between the top plate 34 and gate 38 is achieved and registered on the gage 162.

The application of fluid pressure to the cylinder 140 effects extension of plunger 142 and causes connecting rod assembly 96 to be displaced vertically to impart seal pressure between the engaging surfaces of slide gate 38 and top plate 34 by pivoting of frame 54 clockwise about pins 66. Any tendency of the mating surfaces of slide gate 38 and top plate 34 to be moved out of parallel alignment during pivoting of frame 54 is readily accommodated by the slide guides 75 which, due to the configuration of the cooperating members, are effective to render the top plate and slide gate mutually self aligning in both the longitudinal and transverse directions.

Following vertical displacement of the connecting rod assembly 96 the safety nut 116 is bottomed against the frame 127 to set the position of the valve 10 against the vessel 12 and to prevent downward displacement of connecting rod assembly 96 in the event of a loss of hydraulic pressure from the system. Drive 52 is next actuated to move the slide gate 38 to its closed position and the valve 10 is in readiness for the admission of molten metal to the vessel 12.

It will be appreciated that location of the springs 136 remote from the pour openings through the valve is effective to protect against spring relaxation, or failure, as may be created by overheating or undue thermal stressing. Furthermore, any tendency for seal pressure to be reduced under the influence of thermal elongation of the connecting rod assembly 96 is retarded by the circulation of cooling air through the connecting rod passage 104. Notwithstanding the above safeguards, the invention provides an effective means for positively preventing molten metal leakage between the top plate 34 and slide gate 38 by permitting an operator to monitor the effectiveness of the seal by observing the gage 162. If for any reason seal pressure is reduced below a safe level, its reduction will appear as a reduction in the pressure in line 152 as registered on gage 162 whereupon, by actuating pump 156, pressure in the fluid system will be increased and the seal pressure returned to a safe operating level.

Conversely, the invention provides, in the event of excessive seal pressure between top plate 34 and slide gate 38, a ready means for relieving the same to return the valve to its desired operating condition. This is accomplished by the operator, upon observing an excessive reading on gage 162, closing the control valve 158 and moving handle 164 on valve 160 to remove the valve from its pressure holding mode, whereupon the pressure in line 152 downstream of valve 160 will be reduced by an amount commensurate with the available volume in that portion of line 152 indicated as "L" in FIG. 2. Desirably the line portion L is of a length to reduce system pressure a predetermined incremental amount such that by repeating the alternate opening of valve 158 and returning valve 160 to its fluid holding mode line pressure will be reduced in known incremental steps until the desired seal pressure level is returned to the valve.

From the foregoing, it will be appreciated that the present invention provides an effective manner of accurately maintaining the desired degree of seal pressure between the operating parts of a sliding gate valve. More importantly, it enables the rapid elimination of an unsafe or disruptive condition in the valve without the need to terminate or otherwise disrupt teeming of molten metal through the valve.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. Sliding gate valve apparatus for controlling the flow of molten material from the outlet of a teeming vessel including a gate movable with respect to said vessel outlet, a movable carrier mounting said gate for movement therewith, means for driving said carrier, a support for said carrier pivotally connected at one end to said vessel, an elongated connecting rod attached at one end to the other end of said carrier support, and fluid-operated loader apparatus operatively connected to the other end of said connecting rod for imparting seal pressure between said gate and said vessel outlet during operation of said valve, said loader apparatus comprising:

(a) a fluid chamber remotely positioned from said gate;

(b) a plunger operative in said fluid chamber for movement in response to the admission or release of operating fluid with respect to said chamber;

(c) fluid supply means for selectively supplying or releasing operating fluid to said chamber;

(d) means connecting said plunger to said other end of said connecting rod for imparting an upward bias thereto in response to the admission of fluid to said chamber;

(e) a fixed stop plate;

(f) said other end of said connecting rod being threaded and receiving thereon a nut engageable with said connecting rod threads, said nut being variably positionable along said connecting rod; and (g) means on said nut for engagement with said stop plate for limiting the downward movement of said connecting rod against the bias imparted thereto.

2. Apparatus according to claim 1 including:

(a) loader support means having a base plate fixed to the wall of said vessel for mounting said fluid chamber; and (b) spring means for absorbing instantaneous displacements of said connecting rod interposed between said fluid chamber and said base plate.

3. Apparatus according to claim 2 in which said stop plate is vertically spaced above said fluid chamber, means forming a clearance opening in said stop plate receiving the threaded end of said connecting rod, and said nut being variably positionable along the connecting rod in engagement with said stop plate for loading said spring means to the desired deflection in addition to limiting the downward movement of said connecting rod against the bias imparted thereto.

4. Apparatus according to claim 3 including axially aligned clearance openings in said base and stop plates respectively to accommodate passage of said connecting rod, said spring means and said fluid chamber including the plunger therein being vertically supported on said base plate in encircling relation about said connecting rod, and said plunger engaging an annular shoulder formed adjacent the threaded end of said connecting rod.

5. Apparatus according to any one of claims 1 through 4 including a return spring in said fluid chamber for biasing said plunger against the fluid admitted to said chamber.

6. Apparatus according to claim 5 in which said carrier support includes oppositely spaced side walls and slide guides on said side walls for slidably mounting said gate carrier, said slide guides each containing a bearing surface for sliding engagement with a mating surface on said gate carrier, said surfaces being formed as segments of a cylinder about an axis parallel with said carrier support side walls.

7. Apparatus according to claim 6 in which the axis of said cylindrical segments resides in the plane containing the longitudinal axis of said carrier support.

8. Apparatus according to claim 5 in which said fluid supply means comprise a fluid supply line containing:

(a) an operating fluid reservoir;

(b) a pump;

(c) valve means including a selectively releasable load holding valve downstream of said pump; and (d) means for registering the fluid pressure in said fluid supply line.

9. Apparatus according to claim 8 in which said valve means includes a flow control valve interposed between said pump and said load holding valve and separated from said load holding valve by a line of predetermined volume.

10. A sliding gate valve apparatus for controlling the flow of molten material from the outlet of a teeming vessel comprising:

(a) a carrier support having rectangularly arranged walls positioned beneath said outlet and having one end pivotally connected to said vessel;

(b) a gate carrier containing a refractory plate having a flow control opening cooperable with said vessel outlet mounted in said carrier support;

(c) slide guides along the side walls of said carrier support having bearing surfaces for sliding engagement with surfaces on said gate carrier that mate with said slide guide bearing surfaces;

(d) means on said side walls for mounting said slide guides for pivotal movement about axes normal to said side walls;

(e) said bearing surfaces being formed as segments of a cylinder about an axis parallel with said frame side wall.

11. Apparatus according to claim 10 in which said cylinder axis is disposed to be substantially intersected by the axis of the flow control opening in said plate.

* * * * *